US005347200A

United States Patent [19]

De Nardis

[11] Patent Number: 5,347,200

[45] Date of Patent: Sep. 13, 1994

[54] STROBE LIGHT SWITCHING ARRANGEMENT WITH REDUCED TRANSIENT CURRENTS

[75] Inventor: Nicholas F. De Nardis, Marshfield, Wis.

[73] Assignee: Multi Electric Mfg. Inc., Chicago, Ill.

[21] Appl. No.: 23,397

[22] Filed: Feb. 26, 1993

[51] Int. Cl.[5] ..... H05B 41/00

[52] U.S. Cl. ..... 315/241 S; 315/291

[58] Field of Search ..... 315/241 S, 241 P, 245, 315/227 R, 291

[56] References Cited

U.S. PATENT DOCUMENTS

| | | | |
|---|---|---|---|
| 3,792,309 | 2/1974 | McDonald | 315/200 A |
| 4,246,514 | 1/1981 | Metzger | 315/241 P |
| 4,296,449 | 10/1981 | Eichelberger | 361/3 |
| 4,310,785 | 1/1982 | Iwata | 315/241 P |
| 4,477,796 | 10/1984 | Kearsley | 340/105 |
| 4,634,842 | 1/1987 | Payne . | |
| 4,663,948 | 5/1987 | Rummel . | |
| 4,672,273 | 6/1987 | Ikawa et al. | 315/241 P |
| 4,684,944 | 8/1987 | Kerlin . | |
| 4,742,277 | 5/1988 | Shibuya et al. | 315/176 |
| 5,140,226 | 8/1992 | Lepper et al. | 315/241 S |
| 5,196,766 | 3/1993 | Beggs | 315/241 S |

*Primary Examiner*—Timothy S. Thrope
*Attorney, Agent, or Firm*—Nicholas A. Camasto

[57] ABSTRACT

A strobe lamp switching system includes first, second and third capacitors of different value for simultaneously storing energy from a DC power supply. The strobe lamp is connected across the power supply and periodically fired by energizing an ignition electrode. The number of capacitors are permitted to discharge through the strobe lamp determines the intensity of its light output. An intensity control energizes a pair of relay operated switches that complete discharge paths for the second and third capacitors. A diode parallels each of the relay operated switches so that the second and third capacitors are charged whenever the power supply is on. A discharge resistor is coupled across the power supply for discharging energy in all of the capacitors when the power supply is off. A parallel set of contacts are included in the energizing path for the relay operated switches, with one contact operated together with the associated switch and the other operated by the ignition circuit to preclude energizing the relay operated switch until a predetermined time after ignition.

8 Claims, 1 Drawing Sheet

STROBE LIGHT SWITCHING ARRANGEMENT WITH REDUCED TRANSIENT CURRENTS

BACKGROUND OF THE INVENTION AND PRIOR ART

This invention relates generally to strobe lamp systems and particularly to an improved switching arrangement for a strobe lamp intensity control system.

U.S. Pat. No. 3,792,309 issued Feb. 12, 1974 and assigned to Multi Electric Manufacturing, Inc. discloses an intensity control system for a strobe lamp of the type commonly used in airplane landing approach lighting systems. The patented system includes an igniter controlled strobe lamp, the intensity of which is selectable by a local or remotely controlled intensity switch for controlling the discharge of various energy storing capacitors through the strobe lamp. In particular, the intensity switch may be controlled by aircraft operating personnel, e.g. a pilot, via a wireless communications link. The intensity of the lamp is directly related to the total available energy therethrough which is a direct function of the number and capacitance of the capacitors permitted to discharge through the lamp. A variable intensity is required to accommodate changes in atmospheric visibility at the landing site and the Federal Aviation Authority (FAA) requires an ability to switch intensity of the strobe lamps without a significant time interruption. The patented system uses a combination of make/break relay contacts to control the charging and discharging of the capacitors. The system of the patent has been in use for many years with highly satisfactory results.

The present invention improves upon the prior art patented circuit by increasing the reliability of the relay switches, particularly the relay switch contacts, and extending the life of the capacitors. This is accomplished by incorporating diodes across the relay contacts that complete the charge paths for the capacitors. The diodes enable all of the storage capacitors to be continually charging and thereby to maintain their charge levels when the system is on, irrespective of the position of the intensity switch, to reduce transient currents during switching. Another aspect of the invention provides synchronization for further transient current reduction.

OBJECTS OF THE INVENTION

A principal object of the invention is to provide an improved switching circuit for a strobe lighting system.

Another object of the invention is to provide a strobe lighting system of increased reliability.

A further object of the invention is to provide an interruption-free strobe light switching system.

BRIEF DESCRIPTION OF THE DRAWING

These and other objects and advantages of the invention will be apparent upon reading the following description in conjunction with the drawings, in which.

DESCRIPTION OF THE PREFERRED EMBODIMENT

Figure 1:
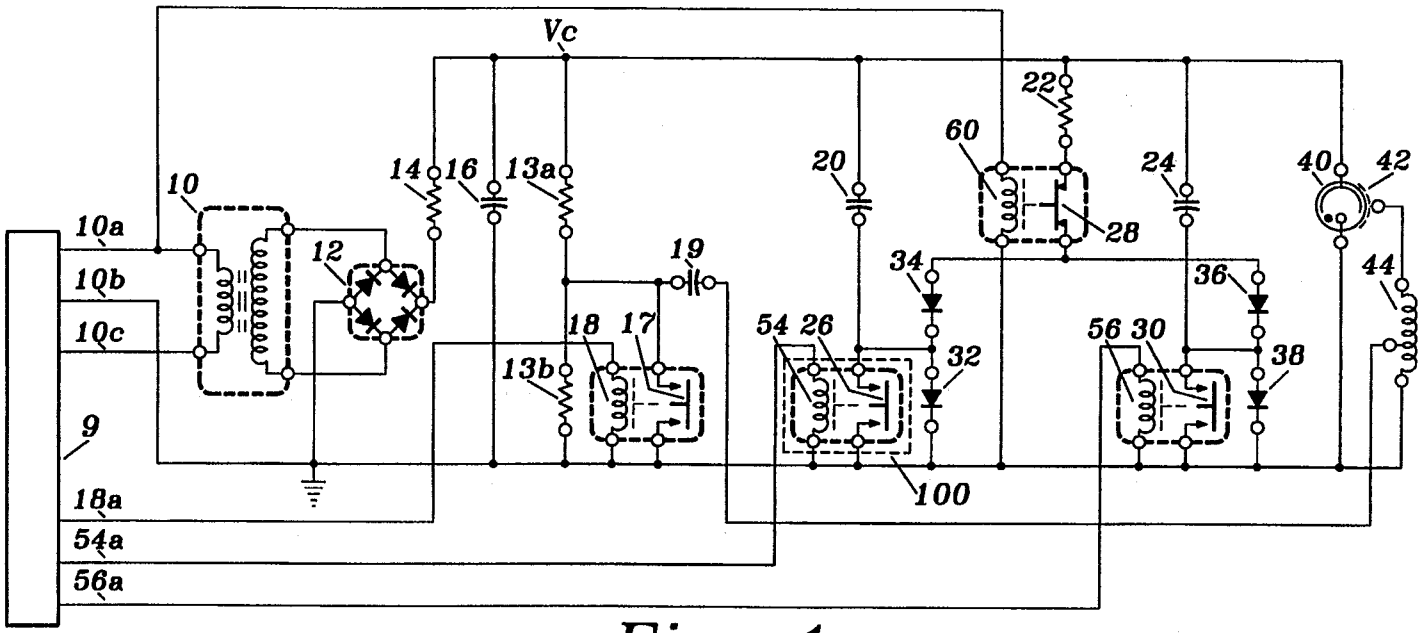
FIG. 1 is a simplified schematic diagram of the switching system of the invention.

Referring to FIG. 1 of the drawings, a source of AC power (not illustrated) is coupled to a well known control unit 9 that supplies operating and switching voltages to the intensity control circuit. Control unit 9 supplies AC operating potentials to a transformer 10 via leads 10*a*, 10*b* and 10*c*. A conventional diode rectifier bridge 12 has a positive terminal coupled to a current limiting resistor 14 and a negative terminal returned to ground. A first storage capacitor 16 of approximately 1 microfarad capacity is coupled to the other end of current limiting resistor 14. Resistor 14 also couples operating voltage Vc to a trigger circuit voltage divider network consisting of serially connected resistors 13*a* and 13*b*. Voltage Vc is also supplied to a second storage capacitor 20 of approximately 3 microfarad capacity, a discharge resistor 22, a third storage capacitor 24 of approximately 26 microfarad capacity and the anode electrode of a strobe lamp 40. The cathode electrode of strobe lamp 40 is connected to ground and its ignition electrode 42 is coupled to an autotransformer 44. The autotransformer winding is returned to ground and its tap is coupled through a control capacitor 19 to trigger relay contact 17 and to the junction of resistors 13*a* and 13*b*. Second capacitor 20 is coupled to ground through a normally open switch contact 26 and third capacitor 24 is similarly coupled to ground through a normally open switch contact 30. Diodes 32, 34, 36 and 38 are connected as shown with diode 32 being coupled across switch contact 26, diode 38 being coupled across switch contact 30 and the anodes of diode 34 and diode 36 being connected to a discharge switch contact 28. Discharge switch contact 28 is connected through a discharge resistor 22 to Vc potential, and the cathodes of diode 34 and diode 36 are connected to the anodes of diodes 32 and 38, respectively. Relay windings 54 and 56 control the operation of switch contacts 26 and 30, respectively, and a discharge relay winding 60 controls the operation of discharge switch contact 28. Appropriate control voltages are developed in control unit 9 and applied over leads 18*a*, 54*a* and 56*a* for activating trigger relay winding 18, relay winding 54 and relay winding 56, respectively. Discharge relay winding 60 is supplied with AC power from lead 10*a* and is seen to be energized whenever the control unit is energized. As indicated by the dashed lines joining the associated components, relay windings 18, 54, 56 and 60 control switch contacts 17, 26, 30 and 28, respectively. The switch contacts 17, 26, 28 and 30 are shown in their inactivated positions, that is contacts 17, 26 and 30 are normally open and contact 28 is normally closed. The prior art patented circuit did not include diodes 32, 34, 36 and 38 and therefore the capacitors 20 and 24 were not held in a charged state. An intensity level change (either or both of leads 54*a* and 56*a* being activated to close their associated contacts) resulted in charged capacitor 16 discharging into either or both of capacitors 20 and 24, which involved fairly large currents and could prove detrimental to capacitor life and contact durability.

In operation, control unit 9 is activated by local or remote means (neither of which is shown) to energize transformer 10 and rectifier 12 whereby DC voltage Vc is supplied to the system. Discharge relay winding 60 is energized and opens contact 28. Capacitors 16, 20 and 24 all charge to Vc potential. Capacitor 16 charges since it is directly connected to ground (i.e. across rectifier bridge 12), whereas capacitors 20 and 24 are charged through their associated diodes 32 and 38, which are poled to permit charging current. All capacitor charging currents flow through current limiting resistor 14.

The intensity of the illumination produced by strobe lamp 40 is directly related to the amount of current that is passed between its anode to its cathode electrodes. As mentioned before, capacitor 16 (of relatively small value) stores a relatively small amount of energy, capacitor 20 stores a larger amount of energy, and capacitor 24 stores a significantly larger amount of energy, generally more than capacitors 16 and 20 combined. At the lowest intensity level, relay windings 54 and 56 are not energized and their respective switch contacts 26 and 30 remain in an open state. The trigger winding 18 is operated by a suitable potential on lead 18*a* to effectively ground capacitor 19 through contact 17 causing autotransformer 44 to pulse the ignition electrode 42 of strobe lamp 40 and enable current flow therethrough. Activation of trigger winding 18 is on a predetermined time and frequency basis as the strobe lamp is just one of a series of such lamps in the airport landing approach lighting system. In general, the strobe lamp circuit is replicated many times to mark an aircraft landing runway and the trigger winding of each strobe lamp circuit is coordinated with the other trigger windings so that the strobe lamps are progressively and repetitively illuminated. This is well known in the art.

When the ignition electrode 42 is energized, the charge stored in capacitor 16 is discharged through the anode-cathode circuit of strobe lamp 40 and a certain minimum level of illumination is produced. The discharge paths of capacitors 20 and 24 are blocked by diodes 32 and 38. Should a higher level of illumination be desired, a suitable potential is applied to lead 54*a* which energizes relay winding 54 to close contact 26. As the voltage levels on both capacitors 16 and 20 are nearly equal, closing contact 26 results in a near zero transient current. When strobe lamp 40 is fired via ignition electrode 42, capacitor 16 and capacitor 20, which are now both conductively connected directly across the anode and cathode electrodes of strobe lamp 40, discharge their stored energy through lamp 40. The intensity of the light output of strobe lamp 40 is correspondingly increased. For high intensity illumination, a suitable potential is applied to both leads 54*a* and 56*a* to energize relay windings 54 and 56 which close their corresponding contacts 26 and 30 resulting in near zero transient currents between the capacitors. When strobe lamp 40 is fired by energization of ignition electrode 42, capacitors 16, 20 and 24 are simultaneously discharged through strobe lamp 40 to produce the highest level of illumination. It will be noted that it is not necessary to discharge all capacitors simultaneously, individual capacitors or combinations thereof may be grouped to achieve different illumination levels. It will also be appreciated that the invention is not limited to mechanical contacts, but that electronic switching arrangements will also benefit from the invention. Current limit resistor 14 is selected to enable full charging of the capacitors to Vc potential, while restricting current flow from the rectifiers 12 through strobe lamp 40 to below its conduction level so that the lamp shuts off after discharge of the stored capacitor energy therethrough.

Whenever control unit 9 is disabled, discharge relay winding 60 is deactivated resulting in contact 28 closing. The closure of contact 28 completes paths from dissipation resistor 22 through diodes 34 and 32 and through diodes 36 and 38 to ground whereby all capacitors 16, 20 and 24 are discharged. This is a safety arrangement to assure that the high energy capacitors are discharged when the system is disabled.

The provision of the diodes 32-38 enables the capacitors (in the preferred arrangement illustrated, capacitors 20 and 24) to continually charge to Vc level as long as the system is active irrespective of the intensity level selected. The arrangement minimizes surge currents thereby extending the lives of relay switch contacts 26 and 30 and of capacitors 16, 20 and 24.

Figure 2:
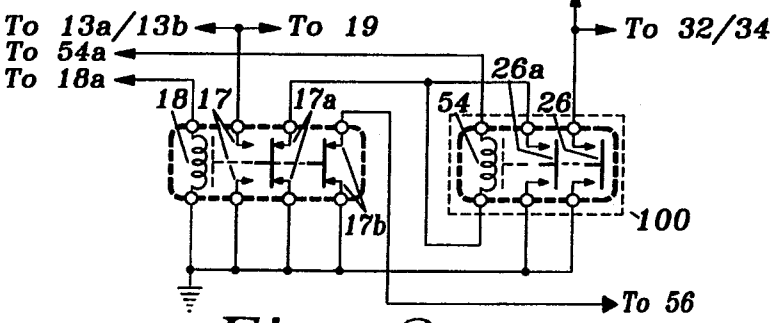
FIG. 2 is a modification of FIG. 1 that provides for synchronized switching.

The embodiment of FIG. 2 further enhances operation of the invention in FIG. 1. As mentioned, trigger winding 18 is activated by a suitable potential on lead 18*a* to effectively connect the hot terminal of capacitor 19 to ground through contact 17. This discharges capacitor 19 through autotransformer 44, producing a high ignition voltage for firing strobe lamp 40. The action of trigger winding 18 is independent of relay windings 54 and 56 except as they may be coordinated by control unit 9. Since a changeover in intensity is often the result of a pilot desiring an increase or decrease in landing light brightness, relay windings 54 or 56 may be energized (by suitable potential on leads 54*a* and 56*a*, respectively), before their associated capacitors (20 and 24, respectively) have been charged to near Vc potential. This condition would likely exist immediately after a firing of strobe lamp 40. In that event, charge in capacitor 16 would result in current flow into capacitor 20 or 24 or both. The current flow could be excessive and might result in strobe lamp 40 being inoperative for a short period of time. It will be appreciated that the above scenario rarely occurs in practice.

The modified circuit precludes this event by adding a set of normally closed break-before-make contacts in the trigger circuit for each illumination level and an additional set of normally open contacts in each energy capacitor circuit to assure that an intensity change is not made for a short period of time after trigger winding 18 operates. As seen, contacts 17 are activated by trigger winding 18, in response to an appropriate voltage on lead 18*a*, to short capacitor to ground and initiate firing of the strobe lamp 40. Contacts 17*a* and 17*b* are normally closed break-before-make contacts that open the path to ground for illumination level shifting relay winding 54 (and relay winding 56, not shown) before contact 17 is closed, thus assuring disruption of the illumination level shifting relay winding circuits for a short time after strobe lamp is fired. If contacts 17*a* are not closed, relay winding 54 cannot be energized until contacts 17*a* resume their closed condition. The holding contact 26*a* operates with contact 26 to provide a path to ground for relay winding 54 whenever the relay winding is energized by the voltage on lead 54*a*, preventing further interruption from contact 17*a*. In this manner, the closing of contact 26 is delayed by the duration of the energization of trigger winding 18. When trigger winding 18 is energized, capacitor 16 is provided with sufficient time to fully charge, eliminating transient currents through contact 26. It will be appreciated that a similar arrangement is required for each intensity capacitor arrangement.

It is recognized that numerous changes in the described embodiment of the invention will be apparent to those skilled in the art without departing from its true spirit and scope. The invention is to be limited only as defined in the claims.

What is claimed is:

1. In combination:

a DC power supply;

a strobe lamp, having an ignition electrode, coupled across said DC power supply;

a first and a second energy storage capacitor coupled across said DC power supply for operating said strobe lamp at corresponding different intensity levels;

means in circuit with said second capacitor enabling said second capacitor to be continually charged from said DC power supply;

trigger means energizing said ignition electrode for periodically discharging one or both of said capacitors through said strobe lamp; and switching means coupled to said second capacitor for connecting it in a discharge path with said strobe lamp.

2. The combination of claim 1 wherein said switching means includes a normally open switch contact in said discharge path and intensity control means for closing said switch contact.

3. The combination of claim 2 wherein said means in circuit include a diode in series with said second capacitor and in parallel with said switch contact, said diode enabling the charging of said second capacitor when said switch contact is open.

4. The combination of claim 3, further including a series connected current limiting resistor between said DC power supply and said first and said second capacitors.

5. The combination of claim 4, further including a discharge resistor connected across said DC power supply for dissipating stored energy in said capacitors when said power supply is off.

6. The combination of claim 2, further including means for preventing operation of said switching means until a predetermined time after energization of said ignition electrode.

7. The combination of claim 2 wherein said last mentioned means comprise a first contact, operated with said switch contact in an energizing path for said switching means and a second contact in parallel with said first contact and operated by said trigger means.

8. A strobe light switching arrangement comprising:

a DC power supply;

a strobe lamp, having an ignition electrode, coupled across said DC power supply;

a first, a second and a third energy storage capacitor coupled across said DC power supply through a current limiting resistor for operating said strobe lamp at different intensity levels;

trigger means energizing said ignition electrode for periodically discharging one or more of said capacitors through said strobe lamp;

intensity selection means for selecting which of said capacitors will be discharged through said strobe lamp for determining said intensity level;

a pair of relay operated switches controlled by said intensity selection means;

a diode in series with each of said second and said third capacitors and in parallel with a corresponding one of said pair of relay operated switches, said diodes enabling continual charging of said second and said third capacitors; and a discharge resistor connected across said DC power supply for dissipating stored energy in said capacitors when said power supply is off.

* * * * *